United States Patent [19]

Tempel

[11] 4,068,844

[45] Jan. 17, 1978

[54] METHOD AND APPARATUS FOR A GAME

[76] Inventor: Gary J. Tempel, 1208 Cottage Road, Webster City, Iowa 50595

[21] Appl. No.: 747,074

[22] Filed: Dec. 2, 1976

[51] Int. Cl.[2] ..... A63F 9/00

[52] U.S. Cl. ..... 273/1 R; 46/29

[58] Field of Search ..... 273/1 R, 1 A; 46/29

[56] References Cited

U.S. PATENT DOCUMENTS

| | | | |
|---|---|---|---|
| 3,014,723 | 12/1961 | Butler | 273/1 A X |
| 3,115,340 | 12/1963 | Stasiuk | 273/1 A |
| 3,176,428 | 4/1965 | Slingluff | 46/29 X |
| 3,226,118 | 12/1965 | Nehl | 273/1 A |
| 3,515,385 | 6/1970 | Gunderson | 273/1 A |

FOREIGN PATENT DOCUMENTS

| | | | |
|---|---|---|---|
| 507,400 | 12/1954 | Italy | 46/29 |

*Primary Examiner*—Paul E. Shapiro

*Attorney, Agent, or Firm*—Henderson, Strom & Sturm

[57] ABSTRACT

A pair of angular interlocking rings are provided as apparatus for engaging in a game. One of the interlocking rings is placed around the neck of a first person, and the other ring is placed around the neck of a second person. The object of the game is for the first and second person to switch the rings from one person to the other. Pairs of individuals then compete, the pair switching the rings the quickest being the winner. A safety device is provided for each ring whereby the ends of the rings will separate from each other if too great a force is exerted thereon.

1 Claim, 5 Drawing Figures

METHOD AND APPARATUS FOR A GAME

BACKGROUND OF THE INVENTION

The present invention relates generally to an apparatus and method for a game.

There are, of course, various and sundry devices known for playing as many different games. Some of such devices have generated considerable interest and others have not. the successful games seem to be simple enough to be played by average persons without extensive training, but yet difficult enough to be challenging so as not to become boring after a short period of time. Consequently, there is a continuing need for new games which fall into this latter category.

SUMMARY OF THE INVENTION

The present invention relates to a new and novel game, and the apparatus for engaging in such game. A pair of interlocking rings are provided of sufficient size so as to fit over a person's head and around a person's neck, but yet not be so big as to pass over the shoulders of persons of average size. The method of using this apparatus includes a first step of placing one of the rings around the neck of one person and the other ring around the neck of another person. The two people are then required to switch the loops to the head of the other person, respectively, in as short a time period as possible. A safety feature is built into each one of the rings for preventing injury to individuals playing the game by allowing one or the other or both of the rings to temporarily break apart if the forces on them become too great.

An object of the present invention is to provide a new and novel method for a game.

Another object of the invention is to provide a new and novel apparatus for a game.

A further object of the invention is to provide an apparatus for performing a particular game, which apparatus is designed for the safety of those individuals using it.

Other objects, advantages and novel features of the present invention will become apparent from the following detailed description of the invention when considered in conjunction with the accompanying drawings.

DESCRIPTION OF THE PREFERRED EMBODIMENT

Figure 1:
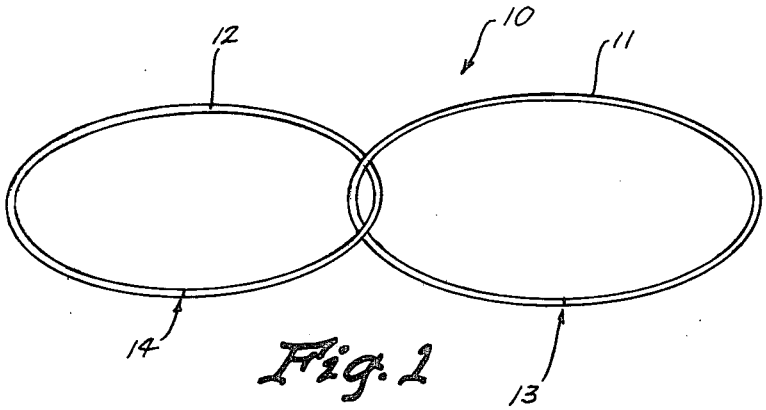
FIG. 1 is a perspective view of the interlocking rings of the present invention.

Referring now to the drawings wherein like reference numerals designate identical or corresponding parts throughout the several views, FIG. 1 shows an apparatus 10 for performing the game of the instant invention. The apparatus 10 consists of a first ring or annular member 11 and a second ring or annular member 12. The second ring 12 is smaller than the first ring 11 for reasons which will be explained below.

Figure 4:
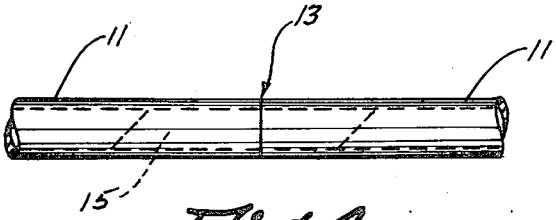
FIG. 4 is an enlarged partial side view of a safety feature of the present invention.
Figure 5:
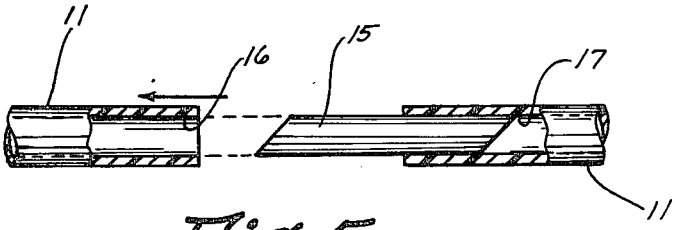
FIG. 5 is a view like FIG. 4, but showing one of the rings having one end separated from the other.

Each of the rings 11 and 12 has a safety joint 13 and 14 respectively. These safety joints 13 and 14 are identical, and can be seen in detail in FIGS. 4 and 5. Referring to FIG. 5, it can be seen that a member 15, having a circular cross section and preferably made of a hard plastic material, is of a shape complementary to the first and second openings 16 and 17 in the first annular member 11. This annular member 11 is formed of a somewhat flexible tubular plastic material having an opening leading therethrough, one end of the opening being referred to as 16 and the other end of the opening being referred to as 17. These portions 16 and 17 are also substantially circular in cross section and are of substantially the same size or slightly smaller, in a relaxed condition thereof, than the diameter of the member 15 so that the member 15 fits within the portion 16 and 17 with a very tight frictional fit. Upon the occurrence of the sufficient pulling forces on the ring 11, the member 15 will be pulled out of one or both of the portions 16 of the ring 11. Upon such occurrence, the ring 11 can again be formed into an annular shape as shown in FIGS. 1–3 by merely reinserting the member 15 to the position shown in dashed lines of FIG. 4.

In order to play the game of this invention, a first person would put the ring 11 over his head and around his neck. A second person would put the ring 12 over her head and around her neck. Then, without using their hands and arms, these two persons would switch the rings by using only their head and body movement. In other words, the first person is suppose to end up with the second ring 12 around his neck, and the second person is suppose to end up with the first ring 11 around her neck for the game to be complete.

Normally, several couples would compete in this game and the time for switching the rings would be recorded. The pair of individuals who switched the rings in the shortest period of time would, of course, be the winner.

Figure 2:
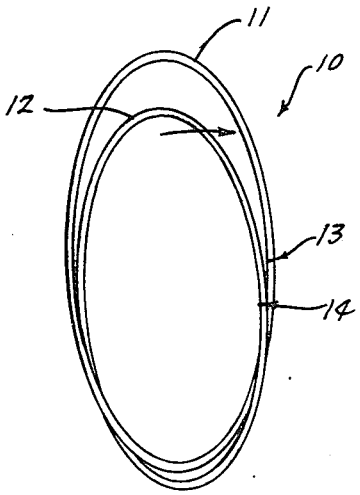
FIG. 2 is another perspective view of the present invention showing one ring passing through the other ring.
Figure 3:
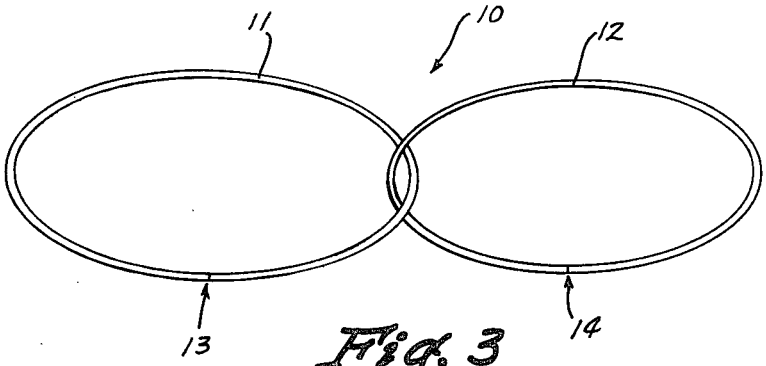
FIG. 3 is still another perspective view of the present invention showing the rings reversed from the position shown in FIG. 1.

It is important that one of the rings be smaller than the other ring so that such smaller ring can pass through the larger ring such as shown in FIGS. 1–3. If the rings 11 and 12 were to be of the same diameter, such switching would not be easily facilitated, if possible at all.

Preferably, the rings 11 and 12 are constructed of flexible plastic of different colors so that there will be no confusion about which ring is which, to facilitate the switching thereof by the participants and in order to allow everyone, including spectators, to know when such switching of rings has been accomplished.

It is also important to emphasize again the safety features of the apparatus of FIGS. 1–5, since it would be dangerous to play such a game if the rings 11 and 12 did not have the safety features 13 and 14. For example, if two individuals were playing this game and one of the individuals would suddenly slip and fall to the floor while the other individual was standing up; and injury, especially to the neck and head could very easily occur. However, with the safety features 13 and 14 present, if such an incident or other similar incidents would occur, one or both of the rings 11 and 12 would merely come apart at joints 13 and 14, and this would prevent such injury to the neck of either of the individuals.

Obviously, many modifications and variations of the present invention are possible in light of the above teachings. It is therefore to be understood that, within the scope of the appended claims, the invention may be practiced otherwise than as specifically described.

I claim:

1. A method of performing a game with apparatus including:

a first annular member, said first annular member having a first end and a second end, said first and second ends having openings therein;

first connection means for connecting said first and second ends of said first annular member comprising a member having a shape complementary to the openings in said first and second ends and positioned in frictional engagement within said first and second openings whereby said first and second ends are held together, but allowing said first and second ends to be separated when sufficient force is applied to said first annular member;

a second annular member in interlocking engagement with said first annular member, said second annular member having a third end and a fourth end, said third and fourth ends having openings therein;

second connection means for connecting said third and fourth ends of said second annular member comprising a member having a shape complementary to the openings in said third and fourth ends of said second annular member and positioned in firm frictional engagement within said third and fourth openings whereby said third and fourth ends are held together, but allowing said third and fourth ends to be separated when sufficient force is applied to said second annular member; and wherein said second annular member is smaller than said first annular member thereby allowing said second annular member to pass through said first annular member from one side of said first annular member to the other side of said first annular member, said first and second members being larger in diameter than the average size of a human head; said method comprising:

placing the first annular member around the neck of a first person;

placing the second annular member around the neck of a second person; and switching the first and second annular members whereby the first annular member is around the neck of a second person and the second annular member is around the neck of the first person, said switching being performed solely by said first and second persons without the use of their hands.

* * * * *